United States Patent [19]

Jacobs

[11] 4,086,643

[45] Apr. 25, 1978

[54] COMBINATION PLUG AND POWER CUT-OFF UNIT

[75] Inventor: David A. Jacobs, Brighton, Mich.

[73] Assignee: JDS Products, Inc., Pontiac, Mich.

[21] Appl. No.: 673,397

[22] Filed: Apr. 5, 1976

[51] Int. Cl.[2] ..... H02H 3/24

[52] U.S. Cl. ..... 361/92; 361/115; 361/331

[58] Field of Search ..... 317/18 A, 18 R, 18 D, 317/9 A, 9 AC, 9 R, 9 D, 137, 154, 31; 340/147 R, 147 LP; 339/14 P, 176 R, 176 MP; 361/88, 90, 92, 1, 23, 33, 331, 335, 356, 357, 351, 376, 417, 115; 174/52 R; 200/51 R, 51.11

[56] References Cited

U.S. PATENT DOCUMENTS

| | | | |
|---|---|---|---|
| 3,602,772 | 8/1971 | Hundhausen et al. | 317/18 R |
| 3,728,581 | 4/1973 | Adamo | 317/18 A |
| 3,761,774 | 9/1973 | Laughinghouse et al. | 317/18 A |
| 3,860,910 | 1/1975 | Hudson | 317/154 X |

*Primary Examiner*—Patrick R. Salce

*Attorney, Agent, or Firm*—Barnes, Kisselle, Raisch & Choate

[57] ABSTRACT

A combination electrical plug and cord and power cut-off unit with a male electrical plug rigidly secured to a housing from which the cord extends, the housing serving as a hard grip for insertion and removal of the plug, the housing containing an electrical relay holding circuit including an externally accessible momentary contact switch wherein a power failure in the supply line will effect a disconnect of the relay requiring a manual actuation of the switch to restore power to the cord leading to a machine or other electrical accessory.

6 Claims, 5 Drawing Figures

COMBINATION PLUG AND POWER CUT-OFF UNIT

This invention relates to a Combination Plug and Power Cut-Off Unit and more particularly to a safety unit for furnishing power to electrical equipment.

In factories and shops, many machines are powered by electricity. In school shops, for example, many saws, lathes, drill presses, planars and shapers are driven by plug-in electrical motors. Also, many factories are set up so that the machines are driven by electrical motors. This may be lathes, milling machines, drills, grinders, stamping presses and the like.

There are occasions when there may be a basic power cut-off. This might result from a major power failure in the vicinity, an intentional cut-off from a master panic switch stemming from an emergency, or an overloaded circuit breaker or fuse failure. When this happens, all machines come to a stop. When the power is restored, any machines which were operating at the time of the cut-off will start up again unless their machine switches were turned to the "off" position. In the case of most machines, this unexpected start-up can be very dangerous.

The present invention has as its object the provision of a hand grip for the wall plug insert which facilitates insertion and removal of the male portion of the plug. It also prevents damage to the cord by making it easy to grip for the connect and disconnect. In addition, the hand grip contains a relay which will automatically disconnect the cord from the power line until a manually operable switch is actuated intentionally to restore power. Thus, upon restoration of the main power source, no plugged-in machine will start until an operator knowingly initiates the restart.

Another object of the invention is the provision of a hand housing which is sturdily constructed to contain the necessary electrical components to provide an inexpensive yet very practical safety device. The United States Occupational Safety and Health Act (OSHA) has directed attention to the safety problems of industry. The present invention is intended to comply with the letter and the spirit of that Act in reference to the restart problems above outlined.

Other objects and features of the invention will be apparent in the following description and claims in which the principles of operation are set forth together with the best mode presently contemplated for the practice of the invention.

Figure 1:
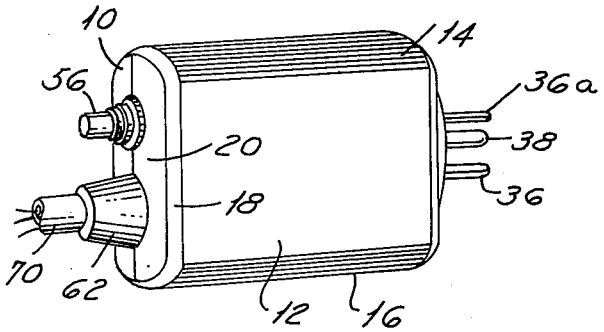

Drawings accompany the disclosure and the various views thereof may be briefly described as:

FIG. 1, a perspective view of the device as assembled.

Figure 2:
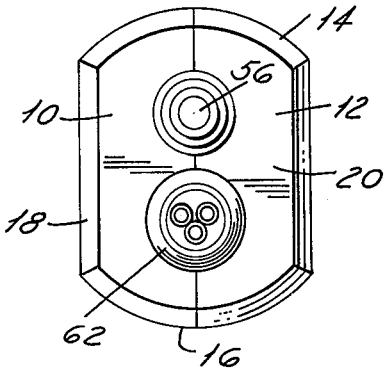

FIG. 2, a view of the left end of the device as illustrated in FIG. 1.

Figure 3:
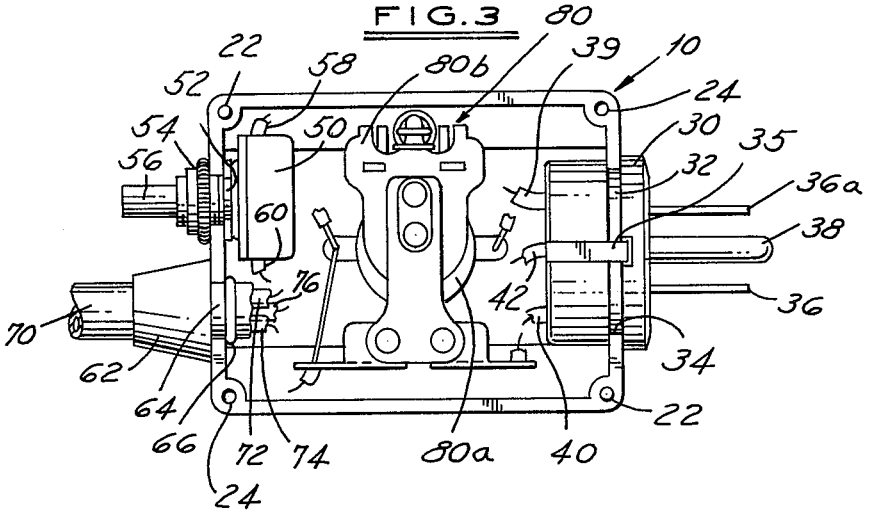

FIG. 3, a view of the device with one-half of the housing removed.

Figure 4:
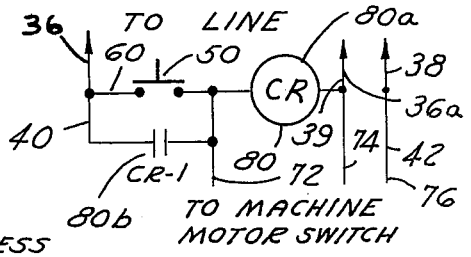

FIG. 4, a line diagram of the electrical circuit utilized in the device.

Figure 5:
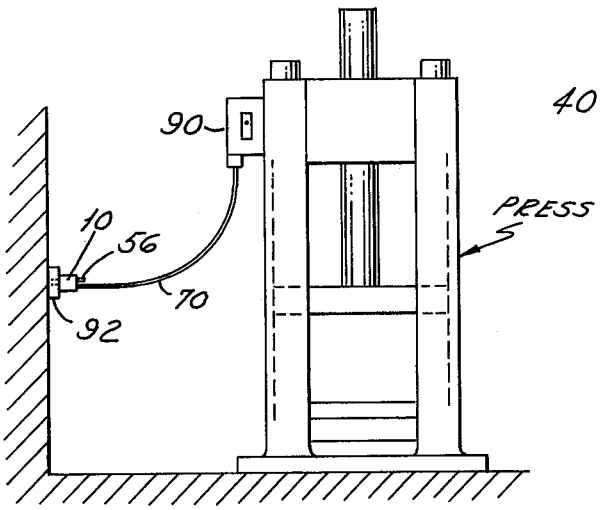

FIG. 5, a view of a motor operated machine utilizing the protective cut-off device.

With reference to the drawings, in FIGS. 1, 2 and 3, the combination plug and cut-off unit is illustrated. A two-piece housing 10, 12 is shown composed of two half shells molded of plastic having flat sides and a serrated, rounded top 14 and bottom 16 to create an oval shaped assembly easy to grip in the hand; the ends are slightly rounded at 18 to a flat surface 20. The shells can be bonded or cemented together or secured in any conventional manner. Pins 22 (FIG. 3) cooperate with holes 24 on the respective shells to insure proper registry of the shells when assembled. At the right-hand end as viewed in FIG. 3 is a male electrical plug having a cylindrical housing 30 provided with an annular groove 32 between its ends. This groove locates in the peripheral edges of an opening 34 formed in the shells 10, 12 so that the housing 30 is securely positioned when the shells are assembled. A notch (not shown) in housing 30 interengages with a tab 35 on shell 12 to prevent the plug from rotating.

The plug housing has two flat parallel male prongs 36, 36*a* and a ground prong 38 extending from the outer end. The inner end of the plug has three wires 39, 40 and 42 to connect the plug into the circuit to be described.

At the other end of the shell housing are two assemblies locked into position between the shells 10, 12. A normally open reset switch housing 50 has a neck portion 52 which is threaded to cooperate with a ring nut 54 which surrounds a spring-biased push button 56. Two wires 58 and 60 connect the switch in the protective circuit. A nipple grommet 62 has a neck portion 64 and an annular flange or ferrule 66 to cooperate with an opening in the shells 10, 12 so that the grommet is locked into position when the shells are assembled. This grommet 62 surrounds a three-wire power cord 70 and secures the cord to the housing. Three wires 72, 74, 76 are in the power cord.

Power cord 70 is connected, of course, to the machine motor 90 to be controlled, as depicted in FIG. 5. A relay shown generally at 80 (FIG. 3) in the shell assembly serves to provide a proper cut-off in the circuit upon failure of a power source. This relay consists of a coil 80*a* and contacts 80*b* of conventional design secured to the wall of shell 10 by a suitable machine screw (not shown). An electrical circuit diagram depicting the preferred interconnection of the various components is illustrated schematically in FIG. 4 wherein reference characters identical to those used in FIGS. 1 to 3 illustrate identical components.

Prong 36*a* is connected via lead 39 to the common or neutral side of relay coil 80*a* and to the common or neutral line 74 of machine power cord 70. Prong 36 is connected via lead 40 to one side of normally open relay contacts 80*b* and to one contact of the normally open switch 50 via lead 60.

Prong 38 and leads 42 and 76 form the machine ground connection. In operation, when switch 50 is activated by depressing the button 56 (FIG. 3), switch contacts are closed, thereby providing a current path through coil 80*a* energizing the coil and closing the normally open relay contacts 80*b*. Relay contacts 80*b* thus provide a current path independent of and parallel to switch 50 whereby the relay is latched in the energized condition and switch 50 may be released. Latched closure of relay switch 80*b* also connects the power available at prong 36 to the machine power cord 70 via conductor 72.

As long as there is power in the main line, that is, at power prongs 36–36*a*, coil 80*a* will remain energized and the contacts 80*b* will remain closed. Should there be a power failure, the control relay coil 80*a* will become de-energized and the relay contacts 80*b* will open. The machine which is receiving power will then be cut off from power even after the main line is re-energized. The manual switch 50 must be re-actuated to connect the power to the machine or service unit 90 to which line 70 (72, 74, 76) is leading. The contacts of the relay switch **80*b*** are gold diffused to provide a high quality contact which will serve for a long period of time without the need for replacement.

In FIG. 5, a press operated by an electric motor 90 is illustrated. The female wall receptacle 92 receives the male plug 30 mounted on the end of the shell housing 10 and 12. Should there be a main power failure while the press is operating, the motor will shut off and upon resumption of power to the plug leads 36, the machine will not operate until button 56 is pressed by the operator. Thus, the operator cannot be injured by a sudden resumption of power to the machine motor.

The housing 10, 12 is about three inches in length with the top and bottom serrated on the surface to provide a grip. Since the plug prong housing 30 is mechanically secured in the housing, the insertion and withdrawal into the wall socket will not put a strain on the wire connections. The main shell housing 10, 12 provides a convenient hand grip for the assembly which obviates the necessity of pulling on the wire 70 to remove from the socket. In addition, the reset switch plunger is conveniently located for a restart after a power failure and restoration. The size and shape of the main shell housing 10, 12 permits two assemblies to be plugged into a duplex type receptacle at the same time. The housing will insert with the flat sides horizontal to accommodate the parallel and side-by-side positioning in a duplex receptacle.

What I claim is:

1. A combination plug and power cut-off unit for safety control of power operated devices which comprises:

(a) an elongate shell housing, (b) a male plug body having electrical contact prongs and provided with an annular recess to receive peripheral portions of an opening in the end of said shell to mechanically lock said plug body in said shell with the prongs outstanding, (c) a power line retainer at the other end of said shell to mount the end of a power line to carry electrical current to an electrically operated device, (d) a manually operated push-button type, normally open, switch mounted at said other end of said shell having a push-button outstanding from said shell, and (e) a relay coil and contacts within said shell to provide a holding circuit around said manually operated switch when power is present in a line into which said prongs are plugged.

2. A combination plug and power cut-off unit for safety control of power operated devices which comprises:

(a) an elongate shell housing having a dimension to permit easy gripping by the hand, (b) a male plug prong unit mechanically mounted in one wall of said shell with prongs outstanding and adapted to be plugged into a source of electrical power, (c) a power line including a plurality of conductors passing through another wall of said shell to provide power to an operating device, (d) a relay comprising a relay coil connected across said power line and a normally open relay switch connected in series with said relay coil across two of said prongs, said normally open relay switch also being connected between one of said two prongs and a selected one of said conductors, and (e) a reset switch comprising an operating member projecting from a wall of said shell and means responsive to actuation of said operating member to provide a current path between said two of said prongs through said relay coil, such that actuation of said operating member energizes a relay holding circuit comprising said relay coil and relay switch to conduct power from said prongs to said power line as long as said prongs are connected to electrical power, interruption of power at said prongs deenergizing said holding circuit and disconnecting power from said power line until said holding circuit is reenergized by actuation of said reset switch.

3. A combination plug and power cut-off unit for safety control of power operated devices which comprises:

(a) an elongate shell housing having a dimension to permit easy gripping by the hand, (b) a male plug prong unit mechanically mounted in one wall of said shell with prongs outstanding and retained in said one wall by an interlock between the periphery of a hole in said shell and an annular recess in said unit, (c) a power line passing through another wall of said shell to provide power to an operating device, (d) a relay coil and relay contacts mounted within said shell, (e) a reset switch mounted in a wall of said shell having an operating member projecting from said shell, and (f) a circuit connecting said prongs, power line, coil, relay contacts and reset switch wherein said relay coil and contacts provide a holding circuit to conduct power from the prongs to the line as long as the prongs are connected to power.

4. A combination plug and power cut-off unit for safety control of power operated devices which comprises:

(a) an elongate shell, (b) means including a plurality of first conductive means carried by one wall of said shell and adapted to be connected to a source of electrical power, (c) means including a plurality of second conductive means carried by another wall of said shell to provide power to an operating device, (d) relay means mounted within said shell comprising a normally open switch and means connected in series with said normally open switch across two of said first conductive means and responsive to a current conducted therethrough to close said normally open switch, said normally open switch also being connected between one of said two first conductive means and a selected one of said second conductive means, and (e) reset switch means comprising an operating member projecting from a wall of said shell and means responsive to actuation of said operating member to provide a current path between said two of said first conductive means through said current responsive means, such that actuation of said operating member energizes a relay holding circuit comprising said current responsive means and said normally open switch to conduct power from said first conductive means to said second conductive means as long as said first conductive means are connected to electrical power, interruption of power at said first conductive means deenergizing said holding circuit and disconnecting power from said second conductive means until said holding circuit is reenergized by actuation of said reset switch means.

5. The combination set forth in claim 4 wherein said plurality of first conductive means is carried in said shell by means retained by an interlock between the periphery of a hole in said shell and an annular recess in said carrying means.

6. A combination plug and power cut-off unit for safety control of power operated devices which comprises:

(a) an elongate shell housing having a dimension to permit easy gripping by the hand, (b) a male plug prong unit mechanically mounted in one end wall of said shell housing with prongs outstanding, (c) a power line passing through another end wall of said shell housing to provide power to an operating device, (d) a relay mounted within said shell housing and comprising a normally open switch and means connected in series with said normally open switch across two of said prongs and responsive to a current conducted therethrough to close said normally open switch, (e) a reset switch comprising an operating member projecting from said other end wall of said shell housing and means responsive to actuation of said operating member to provide a current path between said two of said prongs through said current responsive means, and (f) a circuit connecting said prongs, power line, relay and reset switch wherein said relay provides a holding circuit to conduct electrical power from the prongs to the line as long as the prongs are connected to such electrical power.

* * * * *